United States Patent [19]

Teirlinck et al.

[11] Patent Number: 4,855,107

[45] Date of Patent: Aug. 8, 1989

[54] ALUMINIUM ALLOY FOR THIN METAL SHEETS WHICH ARE SUITABLE FOR THE PRODUCTION OF CAN LIDS AND BODIES AND A PROCESS FOR MANUFACTURING SAID METAL SHEETS

[75] Inventors: Didier Teirlinck, Saint Egreve; Jacques Gagniere, Montreuil-Juigne, both of France

[73] Assignee: Cegedur Societe de Transformation de l'Aluminium Pechiney, Paris, France

[21] Appl. No.: 178,539

[22] Filed: Apr. 7, 1988

[30] Foreign Application Priority Data

May 19, 1987 [FR] France ..... 87 07170

[51] Int. Cl.[4] ..... C22C 21/00

[52] U.S. Cl. ..... 420/546; 148/2; 148/11.5A; 148/127 A; 420/534

[58] Field of Search ..... 420/534, 546; 148/2, 148/11.5 A, 12.7 A

[56] References Cited

U.S. PATENT DOCUMENTS 4,235,628 11/1980 Althoff et al. ..... 148/11.5 A

*Primary Examiner*—R. Dean

*Attorney, Agent, or Firm*—Dennison, Meserole, Pollack & Scheiner

[57] ABSTRACT

The invention relates to an aluminum alloy for thin metal sheets suitable for the production of can lids and bodies, and to a process for manufacturing such metal sheets. The alloy contains, in percent by weight:

from 0.8 to 1.8 manganese
from 1 to 2 silicon
from 0.7 to 3 magnesium
less than 0.7 iron
less than 0.5 copper
less than 0.5 chromium; and
remainder aluminium.

6 Claims, No Drawings

ALUMINIUM ALLOY FOR THIN METAL SHEETS WHICH ARE SUITABLE FOR THE PRODUCTION OF CAN LIDS AND BODIES AND A PROCESS FOR MANUFACTURING SAID METAL SHEETS

The present invention relates to an aluminium alloy for thin metal sheets which are suitable for the production of lids and bodies of cans intended to contain foodstuffs and carbonated drinks and to a process for manufacturing said metal sheets.

Aluminium alloys are widely used nowadays for the manufacture of cans intended to contain solid or liquid foodstuffs as well as carbonated drinks. These cans are composed of two sections: a body with an integrated base, the side wall of which may or may not be printed, to which there is joined a lid equipped with a system for easy opening, particularly in the case of carbonated drink cans. The lids are generally obtained by cutting out a thin metal sheet having a thickness of between 200 and 400 um and the bodies which have a similar thickness are obtained by stamping, or by stamping followed by re-drawing.

It is noted that, depending on the contents of the can, its use for a body or a lid, the shaping method employed, the presence or absence of a system for easy opening or of printing, the sheet metal should have characteristics adapted to each of its particular features.

Thus, easily opening lids should have greater mechanical strength than that of other lids so that they do not tear when being used. The printed or redrawn bodies should have a relatively small proportion of horns to prevent deformation either of the pre-printed characters or of the top section of the body which receives the lid. The redrawn bodies should not crumple on contact with the tools to avoid the appearance of scratches or even of breakages.

Confronted with so many demands, a person skilled in the art has turned to metal sheets produced from alloys of a different composition.

Thus, in the field of cans intended for foodstuffs, there are generally used:

for printed lids and bodies, sheets having a thickness of 230 μm of 5052 alloy in the H28 state according to the Aluminium Association standards, that is to say having the following composition, in percent by weight:

Si 0.25—Fe 0.40—Cu 0.10—Mn 0.10—Mg 2.2–2.8—Cr 0.15–0.35—Zn 0.10—others 0.15—remainder Al.

for the bodies of printed cans, metal sheets of the same thickness, composed of the same alloy but in the H24 state.

In the field of cans intended for carbonated drinks, there are generally used:

for the bodies of cans obtained by stamping-redrawing, metal sheets having a thickness of 330 μm composed of 3004 alloy in the H19 state according to the Aluminium Association standards, that is to say having the following composition in percent by weight:

Si 0.30—Fe 0.7—Cu 0.25—Mn 1,0–1.5—Mg 0.8–1.3—Zn 0.25—others 0.15—remainder Al.

for the lids of cans, metal sheets having a thickness of 300 μm composed of 5182 alloy in the H19 state according to the Aluminium Association standards, that is to say having the following composition in percent by weight:

Si 0.20—Fe 0.35—Cu 0.15—Mn 0.20–0.50—Mg 4.0–5.0—Cr 0.10—Zn 0.25—others 0.15—remainder Al.

It can be deduced from this list that, in particular in the field of cans for carbonated drinks, the lids and bodies have very different compositions, in particular with regard to their magnesium and manganese content. This necessitates different production lines for preparation thereof and also increases their cost price. However, these disadvantages are accompanied by the problem of recycling the cans after use: in fact, in view of the increasing use of aluminium alloys in the cans market, the significant saving to be made by recovering said cans instead of scrapping them has been considered. However, as the bodies are substantially inseparable from the lids, economical recycling involves remelting the entire can. This produces an alloy having an intermediate composition between those of the body and of the lid, which therefore has to be divided into two fractions, each of them then being standardised again by addition of pure aluminium and alloying elements.

It therefore appears more advantageous, with regard to recycling, to use a single type of alloy. However, this alloy should still meet all the requirements imposed on metal sheets whether by their destination: foodstuffs or carbonated drinks, or by their shape: bodies or lids, or by the method of production thereof: stamping or stamping-redrawing or by some of their particular features such as the systems for easy opening on the lids or the suitability for the appropriate development of pre-printed characters or motifs.

The applicant has proceeded with this in mind. This has enabled him to find an alloy composition which is such that it leads, by casting in strips followed by a number of suitably selected shaping operations and thermal treatments, to the production of metal sheets having characteristics capable of withstanding the various stresses to which they will be subjected.

Of course, the applicant is not the first person to have solved the problem in this way. For example, French Pat. No. 2 432 556 can be mentioned, which teaches "a process for the production of a strip of aluminium alloy suitable for the production of can bodies and lids by stamping and redrawing, characterised in that:

(a) a molten mass of an aluminium alloy is prepared which, in addition to the normal impurities, contains as main constituents from 0.4 to 1.0% of manganese and from 1.3 to 2.5% of magnesium, the total magnesium and manganese content being from 2.0 to 3.3% and the ratio of magnesium to manganese being from 1.4:1 to 4.4:1.

(b) the molten mass is cast continuously into a strip using a strip casting machine.

(c) the cast strip is hot rolled continuously at the casting speed with a reduction of at least 70%, the temperature at the beginning of hot rolling being between 300° C. and the temperature of solidus of the alloy and the temperature at the end of rolling being at least 280° C.

(d) the hot rolled strip is hot wound and is left to cool in still air roughly to ambient temperature and, (e) the cooled hot rolled strip is cold rolled to the final thickness".

In this patent, which also involves the casting of strips, a single alloy and a single production process are used for the bodies of cans and for the lids, except for cold rolling since a harder strip is required for the lids.

Under these conditions, the mechanical characteristics of the sheets obtained are a yield stress at 0.2% of from 250 to 310 MPa, a tensile strength of from 260 to 320 MPa and a breaking elongation of from 1 to 8% in the case of the sheets for the body and respective values of these characteristics of 310–370 MPa, 320–380 MPa and from 1 to 5% in the case of sheets for lids.

In the present invention, the applicant had the object of improving these characteristics, in particular in the case of metal sheets for lids. This object was achieved by turning to an alloy having a higher silicon content which is characterised in that it contains, in percent by weight: 0.8≦manganese≦1.8, 1<silicon≦2, 0.7≦magnesium≦3, iron<0.5, copper<0.5, chromium<0.5, the remainder being aluminium. The higher silicon content, in combination with the magnesium, promotes the formation of $Mg_2Si$, which acts as a hardening agent. Moreover, the presence of an average quantity of manganese which is higher than in the earlier patent has the effect of markedly reducing the phenomena of crumpling when redrawing the can bodies.

The invention also relates to a process for manufacturing said metal sheets. The process involves a number of operations relating to the production, shaping and thermal treatment which are characterised in that:

(a) a molten mass of alloy is prepared and contains as main elements, in addition to the normal impurities, in percent by weight: 0.8≦manganese≦1.8, 1<silicon≦2, 0.7≦magnesium≦3, iron<0.7, copper<0.5, chromium<0.5.

(b) said mass is cast continuously into strips having a thickness of between 4 and 20 mm.

(c) the cast strip is heated to between 500° and 620° C. for 2 to 20 hours, (d) the strip which has been heated is cold rolled to an intermediate thickness (e) the thinner strip is heated at between 500° and 600° C. for 0.5 to 10 minutes and is then quenched in air (f) the strip is cold rolled to the final thickness of the manufactured sheet.

The process therefore involves producing a molten mass of given composition and casting it into strips, for example in a rolling mill which, owing to the high cooling rates, allows a lot of Mg, Si and Mn to be kept in solid solution, making subsequent dissolution easier. The strip preferably has a thickness of between 6 and 12 mm.

After casting, the strip is heated to between 500° and 620° C. for 2 to 20 hours in order to homogenise the metal. Then, after cold rolling to an intermediate thickness, the strip is dissolved at a temperature of between 500° and 600° C. for 0.5 to 10 minutes and is then quenched in air so as to produce characteristics which are better than those of conventional alloys. This dissolving treatment is preferably carried out at between 530° and 580° C. for 1 to 2 minutes. The strip is then rolled to the final thickness and the sheet is optionally reheated to 200°–220° C. for 5 to 15 minutes so as to bake the lacquers. Artificial ageing can optionally be carried out for 30 minutes to 2 hours at between 100° and 250° C. to an intermediate thickness between the dissolution-quenching thickness and the final thickness.

These operations can be applied to the manufacture of metal sheets suitable for all types of can lids and bodies described above.

It can be noted that, in contrast to French Pat. No. 2 432 556, all the rolling operations have been carried out cold and that the dissolving thereof is carried out at a temperature of between 500° and 600° C. for 30 seconds to 10 minutes whereas, in the patent, rolling is carried out, in part, under heat and that the dissolution temperature is between 350° and 500° C. for a maximum period of 90 seconds.

Depending on the particular use which will be made of the metal sheets, the operating conditions described above can be modified and complementary operations can optionally be introduced to optimise the process.

The invention can be illustrated by the following embodiment:

To manufacture lids of cans intended to contain carbonated drinks:

(a) the alloy having the following composition, in percent by weight, was cast into a 7.5 mm thick strip:

Mg: 0.80
Mn: 1.08
Si: 1.25
Fe: 0.40

(b) the cast strip was heated for 6 hours at 540° C.

(c) the strip was cold rolled to a thickness of 1.5 mm (d) the thinner strip was heated for 5 minutes at 560° C. and quenched in air (e) the strip was cold rolled to the final thickness of 0.33 mm.

Under these conditions, the characteristics of the metal sheets obtained were as follows:

R 0.2=395 MPa
Rm=410 MPa
A %=4.

A great improvement over the values given in French Pat. No. 2 432 556 and mentioned above, that is to say R 0.2=370 MPa and Rm=380 MPa, is noted.

What is claimed is:

1. An aluminium alloy for the production of thin sheets suitable for the production of can lids and bodies, consisting essentially of, in percent by weight:

0.8≦manganese≦1.8
1<silicon≦2
0.7≦magnesium≦3
iron<0.7
copper<0.5
chromium<0.5
remainder: aluminium.

2. A process for the manufacture of thin metal sheets suitable for the production of can lids and bodies intended to contain foodstuffs or carbonated drinks, comprising the steps of:

(a) preparing a molten mass of alloy which consists essentially of, in addition to the normal impurities, in percent by weight: 0.8≦manganese≦1.8, 1<silicon≦2, 0.7≦magnesium≦3, iron<0.7, copper<0.5, chromium<0.5, remainder aluminum;

(b) continuously casting said mass into at least one strip having a thickness of between 4 and 20 mm;

(c) heating the at least one cast strip to between 500° and 620° C. for 2 to 20 hours;

(d) cold rolling the heated strip to an intermediate thickness;

(e) heating the strip of intermediate thickness to between 500° and 600° C. for 0.5 to 10 minutes and then quenching in air; and (f) cold rolling the quenched strip to the final thickness of the manufactured sheet.

3. A process according to claim 2, wherein said at least one cast strip has a thickness of between 6 and 12 mm.

4. A process according to claim 2, the strip of intermediate thickness is heated at between 530° and 580° C. for 1 to 2 minutes.

5. A process according to claim 2, additionally comprising artificially aging the strips of intermediate thickness for 30 minutes to 2 hours at between 100° and 250° C.

6. A process according to claim 2, additionally comprising heating the final metal sheet for 5 to 15 minutes at between 200° and 220° C.

* * * * *